United States Patent [19]

Moller

[11] 4,165,016

[45] Aug. 21, 1979

[54] EASY OPEN RECLOSABLE END UNIT

[75] Inventor: Jens L. Moller, Darien, Ill.

[73] Assignee: The Continental Group, Inc., New York, N.Y.

[21] Appl. No.: 923,887

[22] Filed: Jul. 12, 1978

[51] Int. Cl.[2] ..... B65D 41/32

[52] U.S. Cl. ..... 220/270; 220/307; 220/359

[58] Field of Search ..... 220/266–274, 220/359, 307; 222/541

[56] References Cited

U.S. PATENT DOCUMENTS

| | | | |
|---|---|---|---|
| 3,731,835 | 5/1973 | Hawkins et al. | 220/359 X |
| 3,952,911 | 4/1976 | Bozek et al. | 220/307 X |

*Primary Examiner*—George T. Hall
*Attorney, Agent, or Firm*—Charles E. Brown

[57] ABSTRACT

An easy open reclosable end unit which includes a metal end unit securable to a container body by means of a seam and having a dispensing opening therein. The dispensing opening is closed by a removable closure initially bonded to the end unit and being peelable therefrom. A cam mechanism is provided for effecting the initial rupture and peeling of the closure with the cam unit being lockable with respect to the closure after the end unit has been seamed to the container. The raw edge of the metal defining the dispensing opening is provided with a guard member and the closure has a plug portion tightly fitting within the guard member and interlocking therebelow to effect reclosing.

14 Claims, 3 Drawing Figures

EASY OPEN RECLOSABLE END UNIT

This invention relates in general to new and useful improvements in end units for containers, and more particularly to an easy open reclosable end unit.

It is well known to provide end units for containers which include primarily a ring element seamed to the container body and a separate closure element which snaps into the ring element. However, such end units are not truly sealed from the standpoint of a sealed container.

It is also well known to provide end units wherein the end panel has a removable panel portion. However, such end unit, while they are of the easy open type, are not readily reclosable.

In accordance with this invention, it is proposed to provide an easy open end unit which is fully sealed, and at the same time is reclosable.

In accordance with this invention, there is provided an end unit which includes an end panel having a peripheral seam forming portion for securement to a container body with the end panel being primarily in the form of a ring and having a large dispensing opening therein. The dispensing opening is closed by a closure member which overlies the dispensing opening and is bonded to the end panel surrounding the dispensing opening. A pull tab or cam unit is provided for initiating rupture of the bond between the closure member and the end panel and the peeling of the closure member from the end panel.

The end unit is intended to be double seamed to a container body and thus clearance must be provided for the seaming chuck. On the other hand, it is desired that the dispensing opening be as large as possible. Accordingly, the cam unit or pull tab is formed separately from both the closure member and the end panel and is so constructed whereby it may be pressed into interlocking engagement with the closure member after the end unit has been seamed to the container body.

Another feature of the invention is the provision of a guard member which protectively engages over the raw edge of the end panel and remains in place after the opening of the container so as to guard against injury during the removal of a product from the container.

The guard member has a second function in that it defines the dispensing opening and snugly receives a depending plug portion on the closure member so as to hold the closure member in a container reclosing position. Further, the plug portion may have a radially outwardly directed projection for interlocking beneath the guard member.

The end unit is particularly adapted for use with large size cans, and most particularly with respect to a ham can. Further, the end unit is particularly adapted for use in combination with a ham can which is formed of plastics material and which has an enlarged open end and includes an outwardly facing internal shoulder over which the end unit directly lies.

With the above and other objects in view that will hereinafter appear, the nature of the invention will be more clearly understood by reference to the following detailed description, the appended claims, and the several views illustrated in the accompanying drawings.

IN THE DRAWINGS

Figure 3:
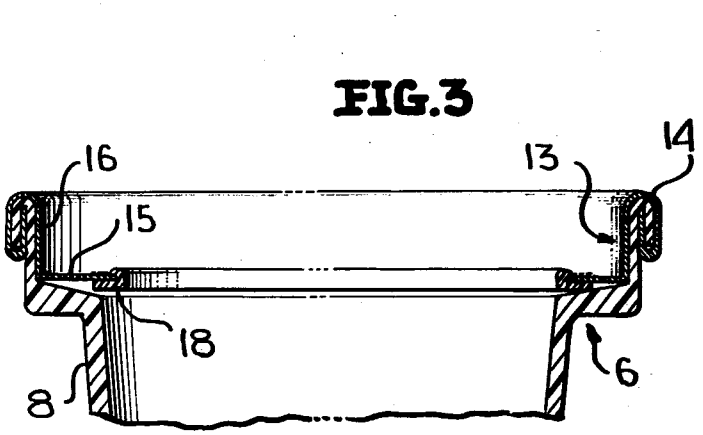
FIG. 3 is a fragmentary vertical sectional view similar to FIG. 2, but on a smaller scale and with the closure member removed.

Referring now to the drawings in detail, it will be seen that there is illustrated a ham can which is generally identified by the numeral 5. The ham can includes a conventional can body 6 which is preferably formed of plastics material and is of a molded construction. The details of the can body 6 will not be described except for those portions to which this invention directly relates. The upper end of the container body 6 is closed by an end unit 7 which is the principal feature of this invention.

Figure 2:
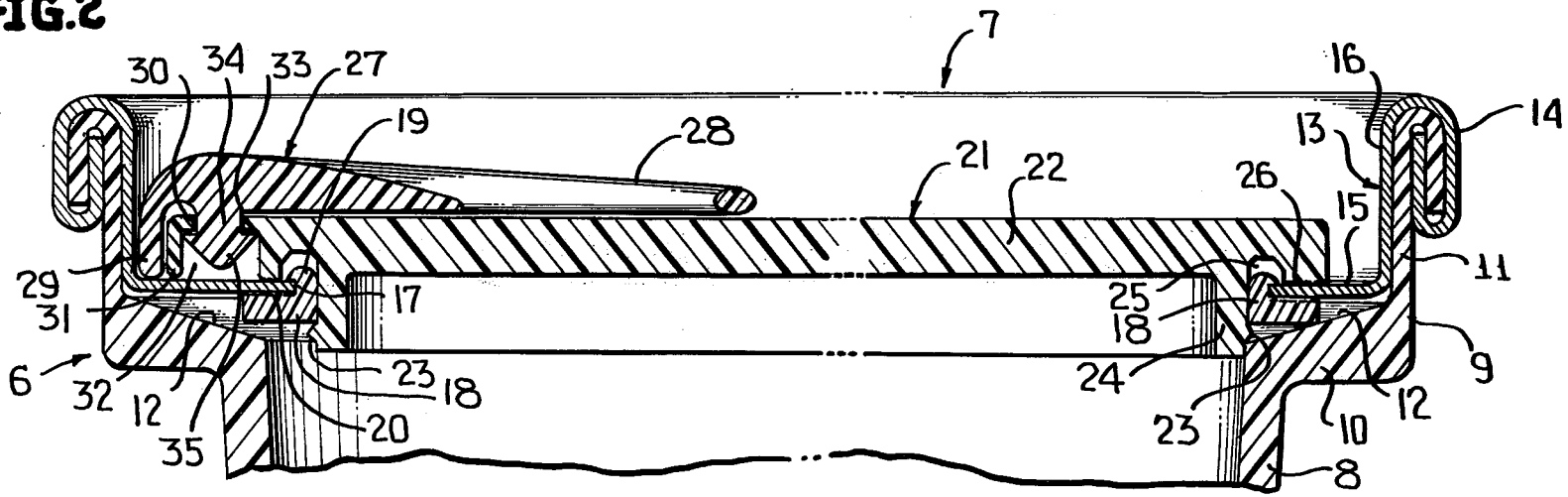
FIG. 2 is an enlarged fragmentary vertical sectional view taken along the line 2—2 of FIG. 1, and most specifically illustrates the opening mechanism of the end unit.

Referring now to FIG. 2, it will be seen that the can body 6 includes a primary body portion 8 which is provided at the upper end thereof with an enlarged portion 9, the enlarged portion 9 including a thick radially outwardly directed shoulder 10 and a seam forming portion 11. The shoulder 10 has an upper surface which slopes downwardly and inwardly, the upper surface being identified by the numeral 12.

The end unit 7 includes a ring member generally identified by the numeral 13, which is formed of sheet metal and which is conventionally secured to the seam forming portion 11 by means of a double seam 14. The ring unit 13 includes an end panel 15 and an adjacent chuck wall 16, as is conventional in closures for can bodies including the special can body 6.

The end panel 15 is formed with a large opening which substantially matches the opening of the main portion of the can body 6. The opening in the end panel 15 is identified by the numeral 17. It is to be understood that in the formation of the opening 17 a raw edge will normally be formed on the end panel 15. To protect against injury by the raw edge there is provided a guard member 18 which is of a generally rotated L-shaped cross section and which includes a foot portion 19 which completely encases the raw edge of the end panel 15. The guard member 18 is permanently bonded to the underside of the end panel 15 by means of a bond 20.

The end unit 7 also includes a closure member generally identified by the numeral 21. The closure member 21 includes a main body portion 22 which has depending from the underside thereof a hollow plug 24. The plug 24 is of a size snugly to fit within the guard member 18 and thus generally form a seal therewith. The lower part of the plug 24 is provided with a radially outwardly directed projection 23 which snaps beneath the guard member 18 and holds the closure member 21 in place against accidental removal.

The underside of the main body portion 22 peripherally outwardly of the plug 24 is provided with a recess 25 which, in turn, provides clearance for the foot 19 of the guard member 18. Peripherally outwardly of the recess 25, the closure member 21 is seated on the end panel 15 and is initially secured thereto in sealed relation by means of a bond 26. It is to be understood that the bond 26 is sufficiently permanent so that in the normal handling of the can 5, this bond will not be ruptured. On the other hand, the bond 26 is peelable so that the closure member 21 may be removed from the end panel 15.

Figure 1:
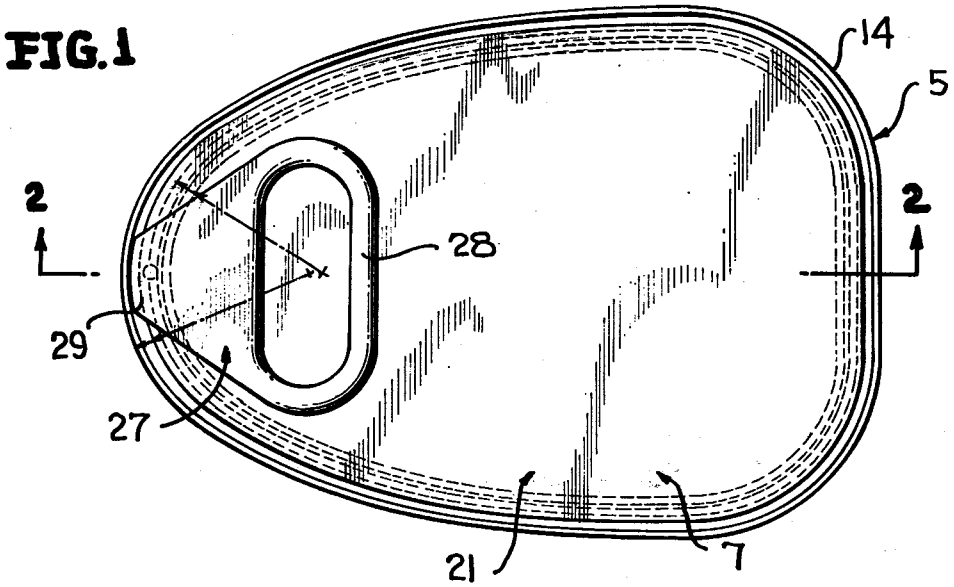
FIG. 1 is a plan view of a ham can incorporating the end unit of this invention.

In order to effect the removal of the closure member 21, there is provided a pull member or cam unit generally identified by the numeral 27. The pull member 27 is generally triangular in outline, as shown in FIG. 1, and is provided at one end with a grip portion 28 and at the opposite end with a fulcrum portion 29. There is a pivotal connection 30 between the pull member 27 and the closure member 21 intermediate the grip portion 28 and the fulcrum portion 29. Most specifically, it is to be noted that a peripheral portion of the closure member 21 extends beyond the bond 26. This peripheral portion is identified by the numeral 31 and is generally hollow so as to define a downwardly facing opening 32. The peripheral portion 31 has formed in the upper part thereof a passage 33. Extending through the passage 33 is a pivot pin 34 depending from the underside of the pull member 27. The pivot pin 34 has an enlarged head 35 disposed within the opening 32 and permanently securing the pull member 27 to the closure member 21.

It is to be noted that the closure member 21 is disposed quite close to the chuck wall 16. This is particularly true of the projecting portion 31. It is also to be noted that the fulcrum portion 29 substantially entirely fills the space between the chuck wall 16 and the adjacent projecting portion 31. Thus, the end unit 7, as illustrated, could not be double seamed to the can body 6 utilizing conventional equipment. However, if the pull member 27 is omitted, the double seaming may be effected in a conventional manner. Accordingly, when the closure member 21 is bonded to the end panel 15, the pull member 27 is separate and apart therefrom. The end unit 7, in the absence of the pull member 27, may be readily double seamed to the can body 6. After the seaming operation has been completed, the pull member 27 is assembled with the closure member 21 by merely forcing the head 35 of the pivot pin through the passage 33 so as permanently to interlock the pull member 27 with the closure member 21.

When it is desired to open the ham can 5, the pull member 27 is pivoted by lifting the grip portion 28 with the result that the fulcrum portion 29 bears against the end panel 15, and the part of the closure member 21 adjacent the projecting portion 31 is lifted so as initially to rupture the bond 26. Then by pulling upwardly on the closure member 21 utilizing the pull member 27, the bond 26 may be completely ruptured in a peeling action.

After the closure member 21 has been removed, substantially full access to the interior of the can body 6 is possible, as is shown in FIG. 3. The guard member 18 remains in place and fully guards against injury by the raw edge of the end panel defining the opening therein. In actuality, the guard member 18 defines the dispensing opening.

When it is desired to reclose the can 5, it is merely necessary to align the plug portion 24 with the opening defined by the guard member 18 and forcibly to shove the plug portion 24 therethrough. An effective seal is maintained between the plug 24 and the guard member 18. Further, the projection 23 prevents the accidental removal of the closure member 21.

Referring now to the right side of FIG. 2, it will be seen that the guard member 18 and the plug portion 24 may be so proportioned whereby the plug portion 24 may also engage with the interior of the main portion of the can body 6. Further, it will be seen that because of the slope of the shoulder surface 12, the radially outer part of the guard member 18 may seat on the surface 12 and at the same time the projection 23 may be disposed between the surface 12 and the underside of the guard member 18. Thus, a full support of the closure member 21 may be obtained in its reclosed position.

Although the end unit 7 has been specifically illustrated as being utilized in combination with a ham can, it is to be understood that the principles of this invention may apply equally as well to other types of cans and that minor variations may be made in the structural details of the end unit without departing from the spirit and scope of the invention as defined by the appended claims.

I claim:

1. An easy opening end unit comprising an end panel, peripheral seam forming means on said end panel for securing said end panel to a container body, a dispensing opening in said end panel, a closure element overlying said dispensing opening and engaging said end panel peripherally around said dispensing opening, a rupturable seal between said closure element and said end panel, and cam means carried by said closure element and engageable with said end panel radially outwardly of said rupturable seal for effecting rupture of said seal and the removal of said closure.

2. The end unit of claim 1 wherein said cam means includes a pull member having a grip portion at one end and a fulcrum portion at the opposite end, and an intermediate pivotal connection between said pull member and said closure.

3. The end unit of claim 2 wherein said fulcrum portion depends from said pull member adjacent the periphery of said closure and in overlying relation to said end panel.

4. The end unit of claim 2 wherein said pivotal connection includes a headed pivot pin on said pull member and an aperture in said closure radially outwardly of said seal.

5. The end unit of claim 2 wherein said pivotal connection includes a headed pivot pin on said pull member and an aperture in said closure radially outwardly of said seal, and said headed pivot pin having a snap engagement through said aperture whereby said pull member may be applied after securement of said end panel to a container body.

6. The end unit of claim 2 wherein said seam forming means includes a chuck wall, said closure at said pull member being closely adjacent said chuck wall, and said fulcrum portion substantially filling the adjacent space between said closure and said chuck wall.

7. The end unit of claim 1 wherein said closure is a reclosure element and has a plug portion extending into said dispensing opening.

8. The end unit of claim 1 wherein said end panel has a raw edge surrounding said dispensing opening, and there is a guard member protectively engaging on said raw edge with said guard member defining said dispensing opening.

9. The end unit of claim 8 wherein said closure is a reclosure element and has a plug portion extending into said dispensing opening.

10. The end unit of claim 9 wherein said plug portion has a radially outwardly directed projection for interlocking behind said guard member.

11. The end unit of claim 8 wherein said end unit is secured to a container body having a flared upper end and includes an upwardly facing internal shoulder, and said guard member generally overlies said shoulder.

12. The end unit of claim 11 wherein said closure is a reclosure element and has a plug portion extending into said dispensing opening.

13. The end unit of claim 12 wherein said plug portion has a radially outwardly directed projection for interlocking behind said guard member.

14. The end unit of claim 13 wherein said internal shoulder slopes radially inwardly and downwardly, and said plug portion projection being disposed between said guard member and said internal shoulder.

* * * * *